US006739905B2

(12) United States Patent
Yokota

(10) Patent No.: US 6,739,905 B2
(45) Date of Patent: May 25, 2004

(54) ELECTRIC POWER STRIP INCLUDING A CELL CHARGING RECEPTACLE

(75) Inventor: Minoru Yokota, Nakakoma-gun (JP)

(73) Assignee: Kawasaki Electric Wire Co., Ltd. (JP)

( * ) Notice: Subject to any disclaimer, the term of this patent is extended or adjusted under 35 U.S.C. 154(b) by 0 days.

(21) Appl. No.: 10/334,118

(22) Filed: Dec. 31, 2002

(65) Prior Publication Data

US 2003/0139088 A1 Jul. 24, 2003

(30) Foreign Application Priority Data

Jan. 22, 2002 (JP) ..... 2002-013040

(51) Int. Cl.[7] ..... H01R 3/00

(52) U.S. Cl. ..... 439/500; 439/535; 439/652; 174/48

(58) Field of Search ..... 439/500, 535, 439/652; 174/48; 320/102, 111

(56) References Cited

U.S. PATENT DOCUMENTS

| | | | | |
|---|---|---|---|---|
| 2,965,817 A | | 12/1960 | Petersen | |
| 3,215,975 A | | 11/1965 | Kinkaid | |
| 4,323,836 A | * | 4/1982 | Rice | 320/107 |
| 5,598,089 A | * | 1/1997 | Shintomi | 320/111 |
| 2001/0027066 A1 | | 10/2001 | Loh | 439/701 |

FOREIGN PATENT DOCUMENTS

| | | |
|---|---|---|
| EP | 0 678 939 A1 | 10/1995 |
| JP | 3062830 | 7/1999 |
| JP | 11204217 | 7/1999 |
| JP | 11-8032 | 12/1999 |

* cited by examiner

*Primary Examiner*—Tho D. Ta
(74) *Attorney, Agent, or Firm*—Parkhurst & Wendel, L.L.P.

(57) ABSTRACT

An electric power strip with cell charging receptacle including a plurality of plug connecting portions located in a socket body and at least one secondary cell receiving portion located in an opening in an outer surface of the socket body for charging a secondary cell, the plug connecting portions and the cell receiving portions connected by a plurality of conductors for connection to a power source.

2 Claims, 2 Drawing Sheets

ELECTRIC POWER STRIP INCLUDING A CELL CHARGING RECEPTACLE

BACKGROUND OF THE INVENTION

The present invention relates to a receptacle device for connecting electric power plugs to an electric power source, which are used for a variety of electronic apparatuses such as a personal computer, a printer, a monitor TV, a stereo unit, a CD player and the like, and more particularly to a receptacle device having a function adapted to charge a secondary cell, i.e., an electric power strip including a cell charging receptacle.

Recently, a variety of electronic apparatuses have been proposed and developed to satisfy an increase of user's needs, so that many types of the electronic apparatuses are pervaded in private homes. There are a lack of the number of socket devices for connecting the electronic apparatuses to an electric power source. Consequently, a receptacle device having a plurality of plug receiving portions is widely used to connect the electronic apparatuses to the electric power source.

Further, with the development of the electronic apparatuses, all kinds of electronic devices and toys are proposed and electric cells are used as an electric power. Particularly, in the field of a secondary cell which is chargeable or dischargeable, cells of Ni—MH type or lithium-ion type which are light in weight and of a high quality are developed and such the secondary cell is mainly used in place of a primary cell.

When the secondary cell is to be used, the secondary cell placed on a private charger by the user and the charged secondary cell is set on the electronic device or the toy to operate it.

However, in the prior private charger to charge the secondary cell, the plug thereof is inserted into a plug receiving portion of the receptacle device connected to the electric power source so that the secondary cell may be charged. Thus, the shortage of the number of the plug receiving portions will be raised.

SUMMARY OF THE INVENTION

In order to solve such the problems, there is provided a receptacle device for an electric power having a socket body on which an electric circuit means for charging a secondary-cell and a secondary cell receiving portion are formed.

DETAILED DESCRIPTION OF THE PREFERRED EMBODIMENT

Figure 1:
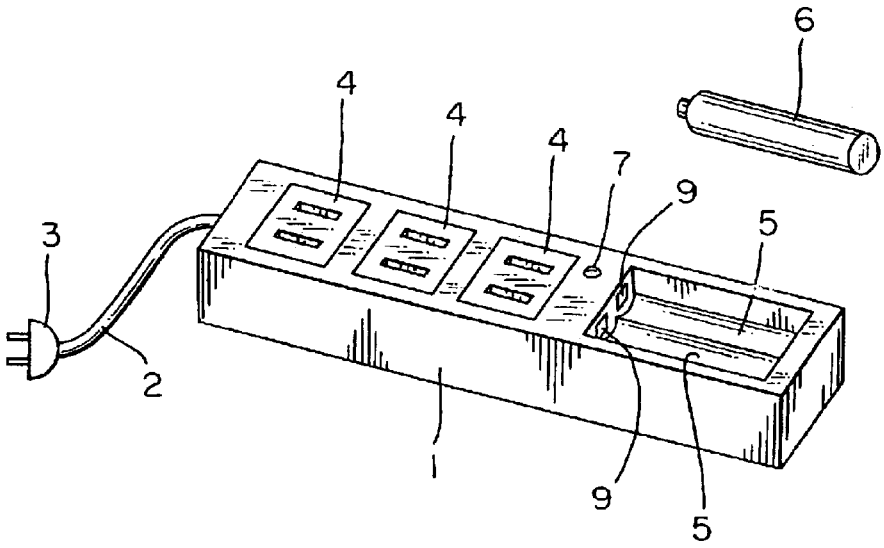
FIG. 1 is a perspective view showing an example of a receptacle device according to the present invention.

FIG. 1 is a perspective view showing an example of a receptacle device for an electric power according to the present invention, which has a socket body 1 with a wire 2 and a plug 3. A supply of an electric power or energy to the socket body 1 is performed through the plug 3.

The socket body 1 of the receptacle device has a plurality of plug connecting portions 4. When the electric power is to be supplied to all types of electronic devices, the plug of each of the electronic devices is inserted into one of the plug connecting portions 4 so that the electric power is supplied to the electronic devices through the receptacle device.

The socket body 1 has secondary cell receiving portions 5 wherein at secondary cell or battery 6 to be charged is placed to charge it. When the secondary cell is charged, a lamp 7 is lighted or put out. By this lamp 7, the user conforms easily a completion of the charging process and can use the charged cell for the electronic device or the toy.

The socket body 1 is made in the form of an oblong box and of a suitable insulating synthetic resin such as Polyvinyl chloride and the like. Each of the plug connecting portions 4 is provided with a pair of opposed blades 10, 10 (refer to FIG. 3) which is made of the electrical conductive metal material and electrically connected to the wire 2 of the plug 3. The blades 10, 10 are electrically and resiliently engaged with contacts of a plug (not shown) of the electronic device or the toy.

Figure 2:
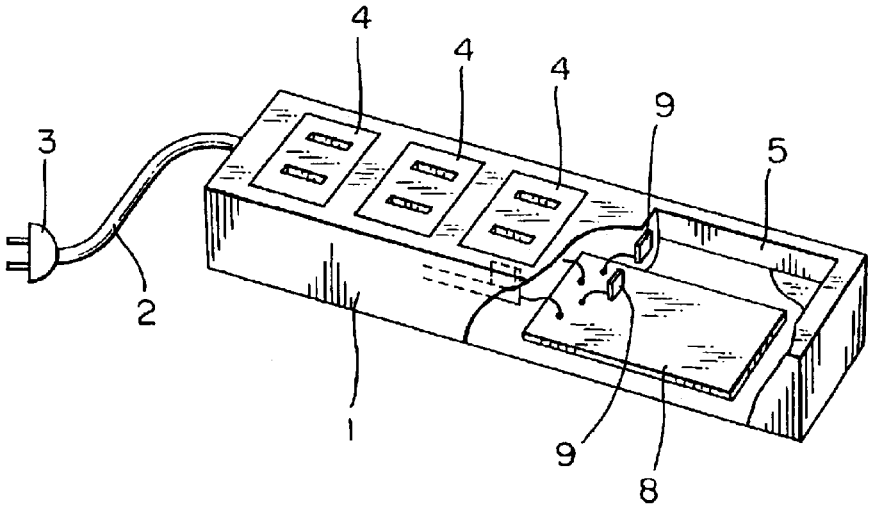
FIG. 2 is a partially broken view showing an example of a receptacle device according to the present invention.

FIG. 2 is a partially broken view of the socket body 1 according to the present invention wherein an electric circuit plate 8 for charging the secondary cell 6 is provided. A supply of the electric power to the circuit plate 8 is performed through the plug 3 of the socket body 1.

The circuit plate 8 for charging the secondary cell 6 is electrically connected to electrodes 9 of each of the secondary cell receiving portions 5. When the secondary cell 6 is to be charged, the secondary cell 6 is inserted in the secondary cell receiving portion 5 and charged through the electrodes 9.

Figure 3:
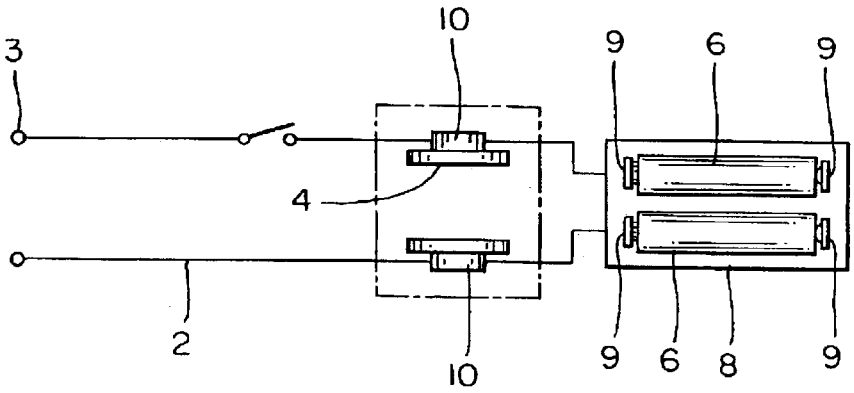
FIG. 3 is an electric circuit as used for an example of a receptacle device according to the present invention.

As shown in FIG. 3, a switch may be preferably connected to either conductor of wire 2 from the plug 3. The conventional electric circuit plate 8 may be used.

In the preferred embodiments as illustrated, the wiring for the electric circuit plate 8 and the electrodes 9 is employed, however, a united means without the wiring can be used.

As explained, the receptacle device according to the present invention is provided with the electric circuit plate or means for charging the secondary cells and the secondary cell receiving portions. As the result, without using the private or exclusive charger, it is possible to charge the secondary cells by simply arranging the secondary cells in its receiving portions formed on the socket body.

As many apparently widely different embodiments of the present invention can be made without departing from the spirit and scope thereof, it is to be understood that the invention is not limited to the specific embodiments thereof except as defined in the appended claims.

What is claimed is:

1. An electric power strip with cell charging receptacle, comprising:

a socket body and a plurality of plug connecting portions therein, said socket body comprising a plurality of conductors for electrical connection between an external power source and said plurality of plug connecting portions, and at least one secondary cell receiving portion connected to said plurality of conductors and located in an opening in an outer surface of the socket body, for charging secondary a cell.

2. The electric power strip according to claim 1, further comprising a charging circuit for charging a secondary cell, said charging circuit connected to said plurality of conductors.

* * * * *